United States Patent [19]

Langford, Jr.

[11] 4,397,361

[45] Aug. 9, 1983

[54] ABRADABLE CUTTER PROTECTION

[75] Inventor: James W. Langford, Jr., Red Oak, Tex.

[73] Assignee: Dresser Industries, Inc., Dallas, Tex.

[21] Appl. No.: 269,285

[22] Filed: Jun. 1, 1981

[51] Int. Cl.[3] ..... E21B 12/04

[52] U.S. Cl. ..... 175/329; 175/307; 175/410

[58] Field of Search ..... 175/329, 330, 374, 375, 175/410, 307, 379, 409, 411; 407/118, 119, 120; 76/101 A, DIG. 12, DIG. 11; 408/144, 145

[56] References Cited

U.S. PATENT DOCUMENTS

| | | | |
|---|---|---|---|
| 2,267,833 | 12/1941 | McMahan | 175/307 |
| 2,296,939 | 9/1942 | McMahan | 255/1 |
| 2,644,672 | 7/1953 | Mathews | 255/72 |
| 3,788,407 | 1/1974 | Lorenz et al. | 175/307 |
| 4,006,788 | 2/1977 | Garner | 175/330 |
| 4,253,533 | 3/1981 | Baker | 175/329 |

FOREIGN PATENT DOCUMENTS

| | | | |
|---|---|---|---|
| 547714 | 10/1957 | Canada | 175/307 |
| 161008 | 6/1964 | U.S.S.R. | 175/379 |

*Primary Examiner*—James A. Leppink
*Assistant Examiner*—Michael J. Starinsky
*Attorney, Agent, or Firm*—Robert D. Clamon; Fred A. Winans

[57] ABSTRACT

A rotary drill bit for drilling earth formations is disclosed having a plurality of cutting elements mounted on the head portion of the bit. The bit further includes a plurality of individual protrusions projecting from the head portion more than the extension of the cutting elements. The protrusions are fabricated of a metal more readily abraded by the earth formation than any of the cutting elements. The protrusions protect the cutting elements during handling of the bit and entry of the bit into a borehole; and, the protectors are abraded away to expose the cutting elements during drilling.

8 Claims, 3 Drawing Figures

ABRADABLE CUTTER PROTECTION

BACKGROUND OF THE INVENTION

1. Field of the Invention

The present invention relates generally to rotary drag bits used in drilling earth formations during exploration for and production of oil and natural gas; and, particularly, to such bits having cutting elements with synthetic diamond cutting surfaces.

2. Description of the Prior Art

Conventional rotary drag bits usually comprise a bit body having an upper end adapted to be attached to the lower end of a drill string. The lower end of the body defines the head portion of the bit which includes a plurality of cutting elements mounted thereon and projecting outwardly from the body for contacting and drilling through the earth formations. The cutting elements may consist of teeth made of tungsten carbide, or they may consist of a layer of natural or synthetic diamonds bonded to a slug, preferably made of tungsten carbide. Generally, such slugs are substantially cylindrical with one end having a planar surface for mounting the diamond cutting surface. The cylindrical portion is adapted to be pressed into bores formed in the head portion of the bit body and positioned to have the cutting surfaces facing in the direction of rotation of the bit. Also, the synthetic diamond cutting surfaces may be cast in place during the formation of the head portion or brazed in place on the head portion. As the bit body is rotated, the diamond cutting edges remove the earth formation at the borehole bottom.

As the diamond cutting surfaces must extend outwardly beyond the body, they are readily exposed to contact. And, as the diamond surfaces are rather brittle, due to their extreme hardness, the cutting surfaces are frequently chipped or broken when the bit is not handled with care. The cutting surfaces can also be easily damaged when the bit is dropped into a bit breaker, which is used to tighten the threaded connection when the bit is attached to the drill string.

Also, the synthetic diamond cutting surfaces can be easily damaged by chipping or breakage when the bit is inadvertently allowed to "tag" bottom (i.e., when the bit is rammed into the bottom of the borehole or as it nears bottom, if the drilling string is rapidly stopped, the drill pipe can stretch, allowing the bit to impact the hole bottom). The damage to the diamond edges can result in the complete loss of effectiveness of the cutting surfaces.

Prior techniques for protecting the cutting surfaces on rolling cutter bits and conventional diamond drag bits (i.e., bits having surface set natural diamond stones) have primarily utilized a bit protector made of a plastic, epoxy, or acrylic material which was molded onto and completely covered the rolling cone cutters or face of the diamond bit and shaped in such a fashion as to permit the easy passage of the bit through the borehole. Other prior techniques for protecting the cutting surfaces have utilized bit protectors made of wood chips or plastic that were molded to fit the contour of the rolling cutters or the diamond drag bit and held in place on the bit by straps or wire ties. Examples of prior art protectors can be found in U.S. Pat. Nos. 2,296,939; 2,644,672; and 3,788,407.

Disadvantages of these prior techniques for protecting the cutting surfaces are the difficulty of obtaining unobstructed circulation paths with the molded-on types and inadequate assurance of removal of the protector once the bit reached bottom. Disadvantages of the strap-on type protectors are the additional metal wires or straps (i.e., junk) in the hole which could damage the bit. Further, such chunks can also plug part of the annular circulation return past the bit.

SUMMARY OF THE INVENTION

The present invention overcomes the above-identified problems by providing a rotary drag bit, utilizing natural or synthetic diamond cutting surfaces, that substantially eliminates damage to the cutting edges during handling, make-up, and tripping to bottom.

Broadly, the present invention provides a drag bit having a plurality of cutting elements extending from the head portion. Each of the cutting elements may have a cutting surface of synthetic polycrystalline diamond bonded thereto. The head portion additionally includes a plurality of protrusions which extend from the head surface a greater distance than do the cutting elements. Thus, an advantage of the present invention is that these protrusions prevent the synthetic diamond cutting surfaces from being contacted when the head portion strikes a hard surface during handling or when the bit inadvertently "tags" the borehole bottom.

Another important advantage of the present invention is that the protrusions rapidly wear down when the bit is rotated on the borehole bottom to allow the synthetic diamond cutting surfaces to engage the earth formation to commence drilling.

The present invention may best be understood by reference to the following description taken in connection with the accompanying drawings.

DESCRIPTION OF THE PREFERRED EMBODIMENT

Figure 1:
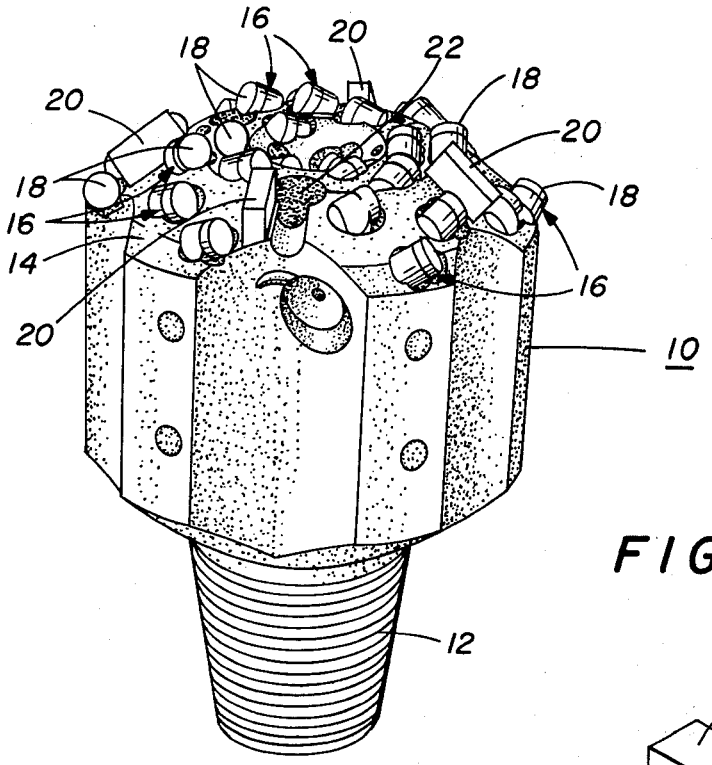
FIG. 1 is a perspective view of a drag bit utilizing synthetic diamond cutting surfaces and having cutting surface protecting protrusions extending from the bit head in accordance with the present invention.

Referring now to the drawing, FIG. 1 illustrates a rotary drill bit comprising a bit body 10 having a threaded pin 12 which is adapted for connection to the lower end of the drill string. The body further includes a head portion 14. Preferably the bit body 10, threaded pin 12, and the head portion 14 are made of steel, although the body and head portion may be made of suitable metal alloys known in the diamond bit art. The head portion of the bit additionally has fluid circulation ports 22 to direct the flow of drilling fluid for removal of cuttings from the borehole bottom and for cooling of the diamond cutting surfaces 18.

A plurality of cutting elements 16 are mounted on and extend from the head portion 14. The cutting elements in the preferred embodiment shown consist of a layer of synthetic diamond 18 bonded to a tungsten carbide slug, however, it is apparent that cutting elements in the form of tungsten carbide inserts could also provide the cutting surfaces. The slug has a substantially cylindrical body with one end having a planar surface for mounting the diamond cutting surface 18. The cylindrical portion of the slugs is adapted to be pressed into mating bores formed in the head portion 14 of the bit body 10 and positioned to have the cutting surfaces 18 facing in the direction of rotation of the bit. As the bit body is rotated, the diamond cutting edges of surface 18 remove the formation at the borehole bottom.

In addition to the cutting elements 16 mounted on the head portion 14, FIG. 1 illustrates the incorporation of four cutter protection protrusions 20 extending from the head portion 14 of the bit at generally 90° spacings. It should be understood that a bit of the type illustrated, i.e. a flat bottom bit, could have any number of cutter protector protrusions 20 spaced about the head portion 14 of the bit in such a fashion as to avoid interference with the mounting of the diamond cutting elements 16 and positioned on the head portion 14 so that the outer surface of the protrusions 20 will contact the formation at the borehole bottom before the cutting elements 16 contact and initially protect the cutting elements 16 by holding them spaced away from the borehole bottom. The greatest degree of protection would be achieved using a protector protrusion 20 sized and shaped in such a fashion as to allow the placement of a protector protrusion 20 closely adjacent to each of the diamond cutting elements 16 on the head portion 14. By decreasing the number of protrusions 20, the degree of protection of each cutting element 16 is accordingly reduced. This reduction in protection can be overcome by increasing the amount of extension of the remaining protrusions 20. Thus, a greater number of closely spaced protrusions 20 will afford a high degree of cutter protection even when the outer surface of the protrusion is only slightly beyond the cutter tip. And, as the number of protrusions 20 is reduced and more widely spaced, the amount of extension of the protrusion 20 beyond the cutting edges 18 should be increased to afford the necessary protection for the cutting edges 18.

Figure 3:
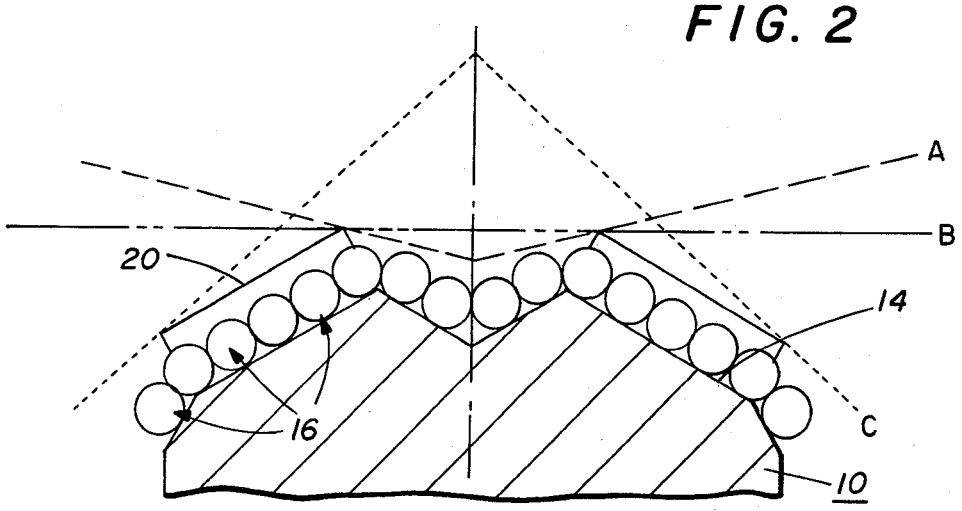
FIG. 3 is a cross-section view of the bit of FIG. 1 taken through two of the cutter protector protrusions located 180° apart with the rows of cutting elements shown rotated into view.

FIG. 3 is a cross-section view of the bit in FIG. 1 taken through two of the cutting protector protrusions 20 located 180° apart. Each row of cutting elements 16 is shown rotated into view in this cross-sectional plane. Thus, the bottom hole patterns cut by the bit can easily be seen. Also, the greater extension above the head 14 of the bit of the protector protrusions 20 is seen relative to the cutting elements 16. Line B (the horizontal line) is representative of a flat surface the bit might encounter, such as the rig floor or bottom of a bit breaker. Line A (the dashed line) is representative of a basically convex bottom hole pattern that the bit might encounter. Line C (the dotted line) is representative of a basically concave bottom hole pattern that the bit might encounter. As can be seen in FIG. 3, the extension and placement of the protector protrusions 20 is such that the cutting elements 16 are prevented from contacting any of these type surfaces until the protector protrusions 20 are abraded or worn down by rotation against these surfaces.

Flat bottomed bits of this type and size, approximately 8¾", will preferably have on the order of 3 to 5 cutter protectors 20 equally spaced on the head 14 of the bit. The cutter protectors 20 extend from the head portion 14 approximately 0.100 inch to 0.125 inch more than the tips of the cutting elements 16. The extension of the protector protrusions 20 being greater than that of the cutting elements 16 insures that the cutting elements 16 will stand off bottom sufficiently on initial contact of the bit with the borehole bottom to prohibit the diamond cutting edges 18 from being damaged on impacting the bottom. The protrusions 20 basically function as legs on which the bit stands when resting on the rig floor, or when resting in a bit breaker for attachment to a drill string. This preferred extension of the protectors 20 provides sufficient stand-off to protect the diamond cutting edges 18 as the bit contacts the irregular bottom of the hole left by the last bit to drill and in handling of the bit at the surface. The cutter protrusions 20 of FIG. 1 are formed integrally with the bit body 10 and are thus generally soft with respect to any cutting surface and readily abradable by the earth formation.

Figure 2:
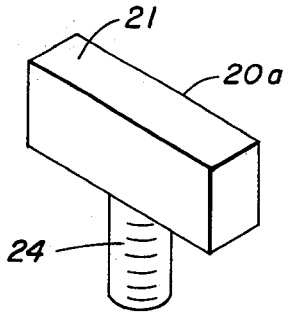
FIG. 2 is a view of one form of a cutter protecting protrusion adapted to be pressed into the head portion of the bit body.

FIG. 2 illustrates an alternate embodiment of the protector protrusion 20*a* adapted to be pressed into bores in the head portion of the bit. This particular embodiment has a rectangular body 21 fixed to a cylindrical mounting stud 24 sized to be pressed into bores formed in the head portion 14 of the bit. It is apparent that a cutter protector protrusion having a cylindrical body configuration fixed to a mounting stud for attachment to the head portion by press fitting could also be used. In such situations where the protector protrusions are attached to the head portion, the protrusions are preferably made of steel, similar to the bit body, however, other metals such as brass, bronze and cast iron may be used as long as they have sufficient strength to resist being crushed by the weight on the bit but are more readily abraded by the earth formation than the cutting elements. The material forming the protrusion is generally more abradable than tungsten carbide, which is well known as a cutting surface or insert material.

Thus, with the present invention, as the bit 10 is lowered into contact with the borehole bottom and rotation is begun, the protrusions 20 rapidly wear or abrade against the borehole bottom wearing the protrusions 20 to such an extent that will allow the synthetic diamond cutting surfaces 18 to engage the earth formation to commence actual bottom hole drilling.

As can be understood from the foregoing discussion, the abradable cutter protectors 20 should have sufficient extension from the bit surface 14 to allow the cutting elements 16 to stand off the hole bottom to prevent initial engagement of the cutting elements 16 with the formation. Preferably, the extension should be approximately 0.100 inch to 0.125 inch greater than the extension of the diamond cutting elements 16, however other extensions can provide the necessary cutter protection. The number of abradable cutter protectors 20 and their placement would be determined basically by the bit size and profile of the head portion 14. For example, a flat bottom 8¾" bit might have three protectors 20 at locations 120° apart and placed on the head portion 14 to avoid interference with the mounting of the diamond cutting elements 16 and positioned on the head portion 14 so that the protrusions 20 will contact the formation at the borehole bottom before the cutting elements 16 contact and initially protect the cutting elements 16 by holding them spaced away from the borehole bottom. Similarly, a 12½" long tapered bit body might have 3 to 5 protectors 20 placed in the long tapered section at approximately equal angular intervals and also placed to avoid interference with the mounting of the diamond cutting elements 16 and positioned on the head portion 14 so that the protrusions 20 will contact the formation at the borehole bottom before the cutting elements 16 contact and initially protect the cutting elements 16 by holding them spaced away from the borehole bottom.

I claim:

1. A rotary drag bit for drilling earth formations comprising:

a bit body having one end adapted to be connected to the lower end of a drill string, the other end comprising a drilling head portion;

a plurality of cutting elements mounted on the head portion and projecting therefrom; and, a plurality of individual protrusions interposed between the cutting elements, integral with and projecting from said head portion more than the extension of the cutting elements and fabricated from a metal more readily abraded by the earth formation than any of the cutting elements on the bit, said protrusions protecting said cutting elements during handling of the bit and entry of the bit into a borehole, and being abraded away to expose the cutting elements during drilling.

2. The bit in claim 1 wherein the cutting elements include a diamond cutting surface.

3. The bit of claim 2 wherein the protrusions are secured to the head portion.

4. The bit of claim 2 wherein the protrusions are fabricated of a metal more readily abraded by the earth formations than is tungsten carbide.

5. A rotary drag bit comprising:

a bit body having one end adapted to be connected to the lower end of a drill string, the other end comprising a head portion;

a plurality of cutting elements mounted on and projecting outwardly from the head portion;

a selected number of said cutting elements having a cutting surface of synthetic polycrystalline diamond defining the outermost projecting surface of said elements; and, a plurality of protrusions interposed between the cutting elements and integral with the head portion, fabricated from a metal more readily abradable than any of said plurality of cutting elements and extending from the head portion more than the outermost projecting surface of said synthetic polycrystalline diamonds to protect the diamond cutting surfaces from damage during handling, said protrusions being readily abraded away during drilling to expose the cutting surfaces for drilling.

6. The bit of claim 5 wherein the protrusions are formed as an integral part of the head portion.

7. The bit of claim 5 wherein the protrusions are made integral to the head portion by soldering, welding, cementing, or a press-fit.

8. The bit of claim 5 wherein the protrusions are fabricated of a metal more readily abraded by the earth formations than is tungsten carbide.

* * * * *